US005404159A

United States Patent [19]

Ohashi

[11] Patent Number: 5,404,159

[45] Date of Patent: Apr. 4, 1995

[54] IMAGE FORMING APPARATUS HAVING TONER PARTICLE MODULATOR WITH ELLIPTICAL APERTURE

[75] Inventor: Tsuyoshi Ohashi, Hashima, Japan

[73] Assignee: Brother Kogyo Kabushiki Kaisha, Nagoya, Japan

[21] Appl. No.: 918,685

[22] Filed: Jul. 27, 1992

[30] Foreign Application Priority Data

Sep. 20, 1991 [JP] Japan ..... 3-241155

[51] Int. Cl.[6] ..... B41J 2/06

[52] U.S. Cl. ..... 347/55; 347/123; 347/128

[58] Field of Search ..... 346/140 R, 159; 347/54, 347/55

[56] References Cited

U.S. PATENT DOCUMENTS 3,689,935 9/1972 Pressman et al. ..... 346/159
5,128,695 7/1992 Maeda ..... 346/159 X
5,135,435 10/1992 Greene ..... 346/159 X
5,270,741 12/1993 Hosaka et al. ..... 346/159 X

FOREIGN PATENT DOCUMENTS 2031344 4/1980 United Kingdom ..... 346/140 R

*Primary Examiner*—Benjamin R. Fuller
*Assistant Examiner*—John Barlow
*Attorney, Agent, or Firm*—Oliff & Berridge

[57] ABSTRACT

An image forming apparatus capable of forming an image with a high-resolution. The image forming apparatus comprises an aperture electrode wherein toner particles are controlled so as to pass through each of the apertures or not so as to pass through each of the apertures. The image forming apparatus capable of forming an image by forming toner dots on a recording medium, has an aperture electrode having a plurality of elliptical apertures such that an minor axis of the aperture is parallel to the direction of movement of the supporting member.

16 Claims, 4 Drawing Sheets

IMAGE FORMING APPARATUS HAVING TONER PARTICLE MODULATOR WITH ELLIPTICAL APERTURE

BACKGROUND OF THE INVENTION

1. Field of the invention

The present invention relates to an image forming apparatus being used for a copier, a printer and or the like, and more particularly, to an image forming apparatus capable of generating an electric field in order to direct charged toner particles to form an image on a recording medium.

2. Description of Related Art

Conventionally, there is an image forming apparatus disclosed in the U.S. Pat. No. 3,689,935. In the image forming apparatus, an aperture electrode having a plurality of small holes or apertures, is provided. The aperture electrode controls the passage of toner particles through each of the apertures upon being applied with a driving signal based on an image signal. Then, those toner particles which pass through each of the apertures are held on a supporting member, so that an image can be recorded on the supporting member, such as a recording paper. In the image forming apparatus of the type described, the aperture electrode comprises an insulative layer, a reference electrode and a plurality of control electrodes. The reference electrode is made of one sheet forming an electric conductor layer on one side of the insulative layer. The control electrodes are formed independently of each other on the other side of the insulative layer, in the longitudinal direction of the insulative layer. Moreover, each of the control electrodes has at least one circular aperture. In other words, the aperture penetrates the above-mentioned three layers (the reference electrode, the insulative layer and the control electrode).

The image forming apparatus further comprises a device for supplying charged toner particles, a control electrode driving circuit for applying electric potential between the control electrode and the reference electrode, a device for moving the supporting member where an image is to be formed.

In the above-mentioned image forming apparatus, the charged toner particles are supplied to the aperture of the control electrodes. Selected ones of the control electrodes receive an electric potential supplied by the control electrode driving circuit, so that a flow of those toner particles increases speed on passing through each of the apertures. Then, those toner particles can pass through the aperture. The toner particles pass through the aperture in a predetermined short time and adhere to the supporting member in the form of a dot. Thus, a plurality of dots are formed on the supporting member based on image data, so that a desired image is formed.

However, each of the apertures provided in the aperture electrode of the above-described image forming apparatus has a circular shape. Therefore, when a plurality of dots composed of toner particles are formed on the supporting member in order to form the image, an interval between dots adjacent to each other in the direction of movement of the supporting member gets narrow, so that there is a problem in that the resolution of the image forming apparatus decreases.

Parts of a dot corresponding to rise and fall of an image signal, that is, both ends of the dot in the direction of movement of the supporting member have semicircular shapes corresponding to the circular aperture. Since each of the diameter portions of those semicircles corresponds to the rise and the fall of the image signal, those semicircles in both ends of the dot in the direction of movement of the supporting member are surplus area. Therefore, each of the dots does not correspond to the image signal accurately. Therefore, when a space where a dot is not formed is small, that is, a time between a fall of the image signal and a rise of the next image signal is short, the interval between dots adjacent to each other gets narrow. So that, the resolution of the image forming apparatus decreases.

SUMMARY OF THE INVENTION

It is therefore an object of the present invention to provide an image forming apparatus capable of forming an image with a high-resolution.

To achieve this object, an image forming apparatus according to the present invention comprises; an aperture electrode having an insulative layer, one sheet of reference electrode formed on one side of the insulative layer, a plurality of control electrodes formed independently on the other side of the insulative layer in the longitudinal direction of the insulative layer, and an aperture formed on each of the control electrodes so as to penetrate the three layers that is, the reference electrode, the insulative layer and the control electrode; electric potential applying means for applying electric potential between each of the control electrodes and the reference electrode; charged toner particle supplying means for supplying charged toner particles to the vicinity of the reference electrode having a plurality of apertures; and moving means for moving a supporting member on which charged toner particles, which have passed through the aperture electrode, adhere so as to form a plurality of dots extending in the direction of movement of the supporting member, and wherein each of the apertures has an elliptic shape and is formed such that the minor axis of the aperture is parallel to the direction of movement of the supporting member.

The charged toner particles are supplied to the vicinity of the apertures by the charged toner particle supplying means. The charged toner particles in the vicinity of the apertures pass through the apertures as a result of an electric potential applied between each of the control electrodes and the reference electrode of the aperture electrode by the electric potential applying means, based on an image signal. The toner particles adhere to the moving supporting member which is at a predetermined position with respect to the aperture electrode. At this time, since each of the apertures has an elliptic shape and is formed such that the minor axis is oriented in the direction of movement of the supporting member, both ends of the formed dot, in the direction of movement of the supporting member, form a gentle curved line in comparison with a semicircular line. Therefore, the image forming apparatus of the present invention is capable of forming an image having a high resolution.

As described above, according to the present invention, the apertures capable of controlling a flow of toner particles are formed as ellipses, with the minor axis of the ellipse corresponding to the direction of movement of the supporting member. Therefore the interval between dots adjacent to each other in the direction of movement of the supporting member is increased. Thus, since an image made of toner particles is accurately formed based on the image signal, the image forming apparatus of the present invention can form an image with a high resolution.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Hereinafter, an embodiment of the present invention will be explained with reference to the figures.

Fig, 1 is a schematic view showing one embodiment of an image forming apparatus of the present invention.

Figure 1:
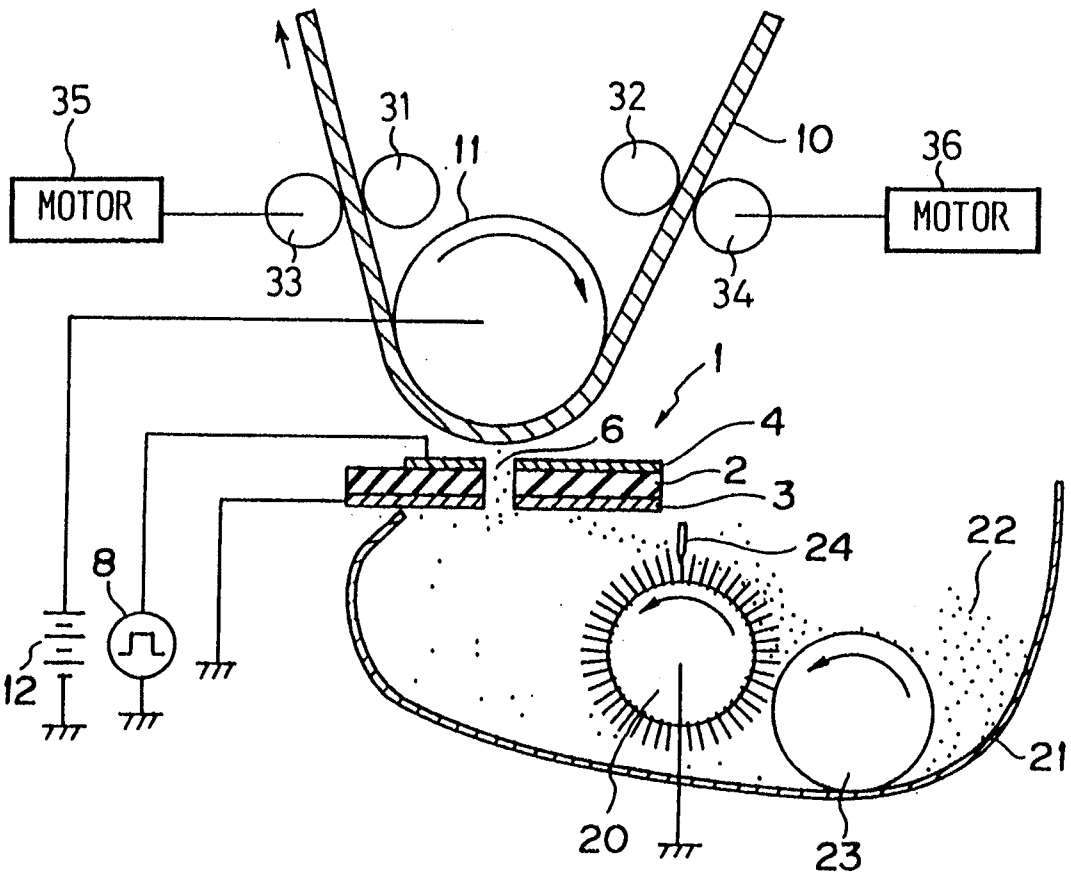
FIG. 1 is a schematic sectional view showing one embodiment of an image forming apparatus of the present invention.

As shown in FIG. 1, the image forming apparatus of the present invention comprises an aperture electrode 1 having an insulative layer 2, a reference electrode 3 and a plurality of control electrodes 4. A sheet forming the reference electrode 3 is disposed on one side of the insulative layer 2. Control electrodes 4 are formed on the other side of the insulative layer 2. Further, the image forming apparatus comprises a brush roller 20 provided in the vicinity of the side of the reference electrode 3 of the aperture electrode 1, a supplying roller 23 and a back electrode 11. A supporting member 10, for example, an ordinary paper, is supported by a pair of transporting rollers 31, 33 and a pair of transporting rollers 32, 34. The transporting roller 33 is rotated by a motor 35, the transporting roller 34 is rotated by a motor 36. Then, the supporting member 10 is transported while coming in contact with the back electrode 11 so as to pass in a predetermined position in the vicinity of the aperture electrode 1. The direction of movement of the supporting member 10 preferably is orthogonal to the longitudinal direction of the aperture electrode 1.

Figure 2:
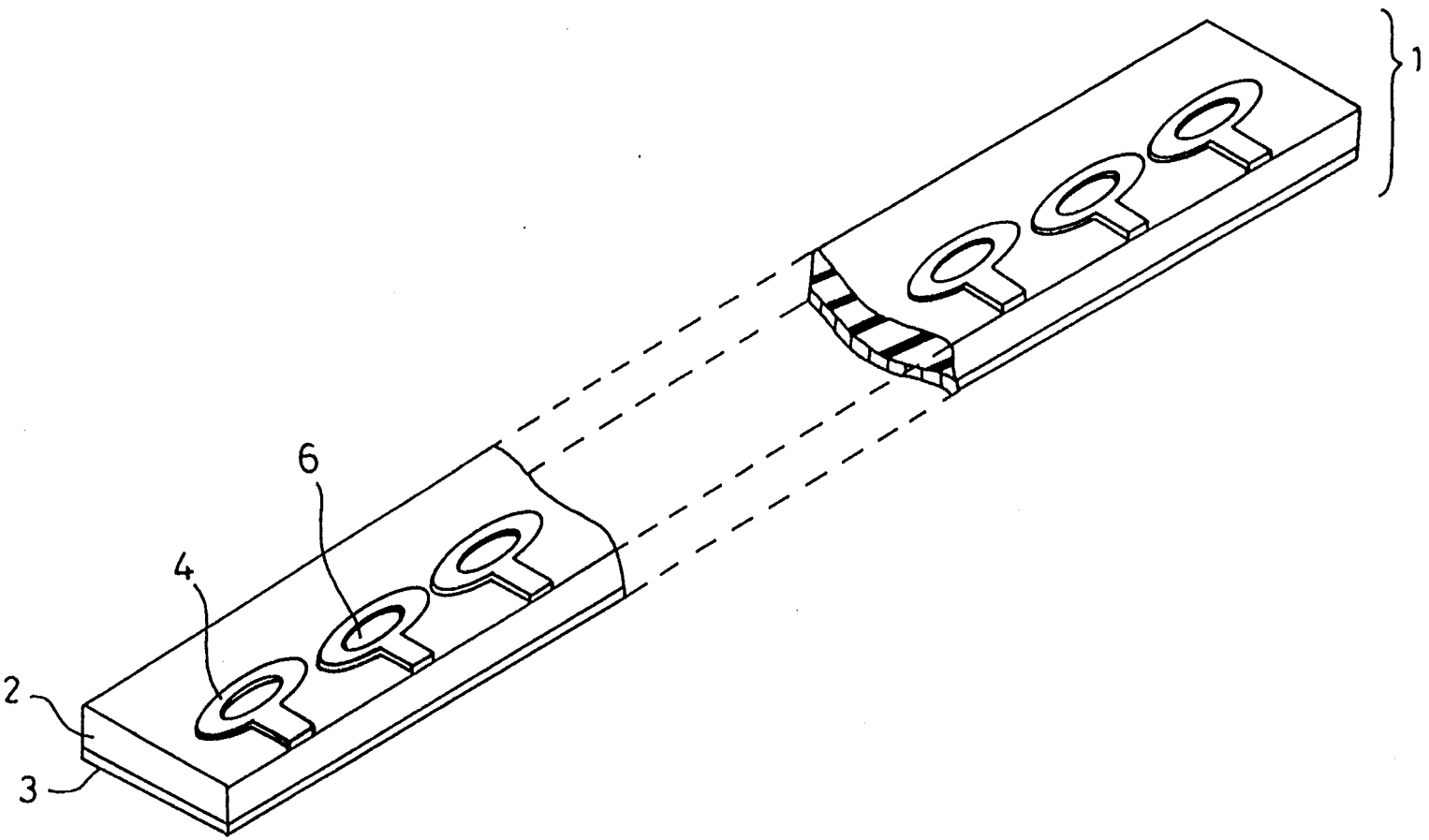
FIG. 2 is a perspective view showing an aperture electrode in detail.

As shown in FIG. 2 in detail, the reference electrode 3 of the aperture electrode 1 is made of one sheet of an electric conductor layer covering the whole area of one side of the insulative layer 2. Moreover, a plurality of control electrodes 4 of the aperture electrode 1 are independently formed on the insulative layer 2. The control electrodes 4 are aligned in the longitudinal direction of the insulative layer 2. And, each of the control electrodes 4 is connected to a control voltage drive circuit 8 shown in FIG. 1 for generating the voltage to be determined based on an image signal.

Figure 3:
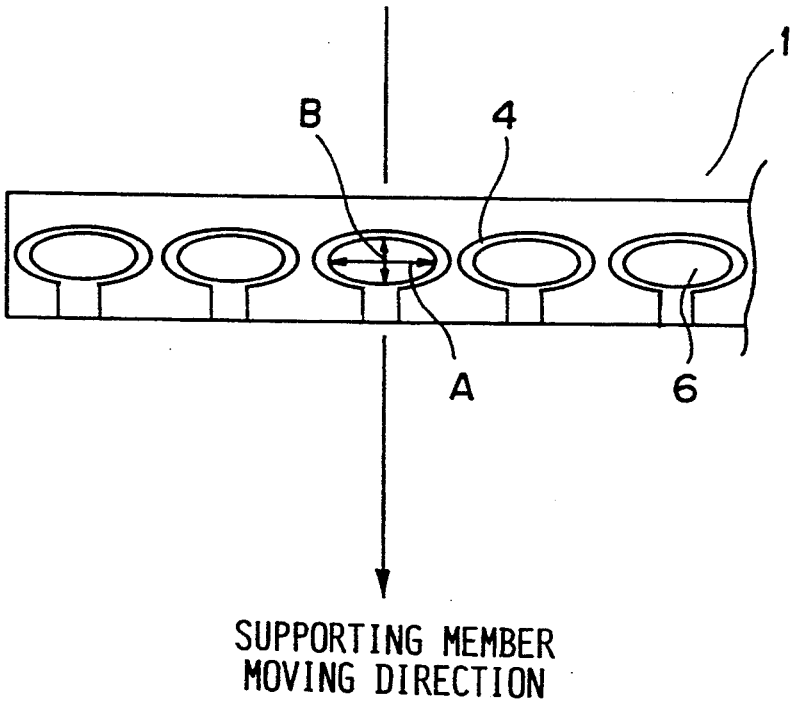
FIG. 3 is a view showing the relation between a shape of the aperture and a moving direction of the supporting member.

Portions of the aperture electrode 1 where the control electrodes 4 are formed have three layers, that is, the reference electrode 3, the insulative layer 2 and the control electrode 4. And, at the center portion of each of the control electrodes 4, an aperture 6 is formed so as to penetrate the above-mentioned three layers. As shown in FIG. 3, the aperture 6 has an elliptic shape. The aperture 6 is formed such that the major axis A (FIG. 3) of the aperture 6 is parallel to the longitudinal direction of the aperture electrode 1 and the minor axis B is parallel to the direction of movement of the supporting member 10. Usually, the length ratio of the major axis A to the minor axis B, that is, A/B, is preferably from about 1.5 to about 3. Moreover, the length of the major axis A is determined based on the desired resolution. For instance, when the resolution is 300 dpi, the major axis is preferably 50–80 αm. The preferred ratio range of the major axis to the minor axis takes into account considerations regarding the size of the toner particles (which must pass through the aperture) and manufacturing capabilities for forming the small apertures. The apertures are precisely formed by means of a laser processing.

The back electrode 11 is used for attracting the toner particles which pass through apertures 6 of the aperture electrode 1 toward the supporting member 10 and is connected to a high voltage power supply 12. The back electrode 11 is given 1 kV positive electric potential by the high voltage power supply 12. The brush roller 20 and the supply roller 23 are arranged in a toner case 21 storing the toner particles 22 therein. Bristles of the brush roller 20 and the supply roller 23 come in contact with each other. The brush roller 20 rotates below the apertures 6 of the aperture electrode 1. A scratch blade 24 is arranged so as to come in contact with the bristles of the brush roller 20.

Next, an operation of the image forming apparatus having the above-mentioned construction will be explained.

When the brush roller 20 and the supply roller 23 rotate, the toner particles 22 in the toner case 21 are rubbed by the bristles of the brush roller 20, so that those toner particles 22 become negatively charged. The charged toner particles 22 are held by the bristles of the brush roller 20. The charged toner particles 22 held by the bristles are carried toward the scratch blade 24 by rotation of the brush roller 20. The scratch blade 24 engages the bristles to bend the bristles. As a result, the toner particles 22 are projected by the elastic power of the bristles and form a mist beneath the apertures 6 of the reference electrode 3.

At this time, when a picture element is determined as an image forming portion based on the image signal, a control electrode 4 corresponding to the picture element receives a positive voltage (100V) from the control voltage drive circuit 8. When a positive voltage is applied to the control electrode 4, an electric field having electric lines of force is formed in or under the aperture 6 corresponding to the control electrode 4. The electric lines of force are directed from the side of the insulative layer 2, where the reference electrode 3 is formed, toward the other side of the insulative layer 2, where the control electrodes 4 are formed. The negatively charged toner particles 22 pass through the aperture 6 according to the flow of the electric field since the toner particles 22 are attracted from the lower side of aperture electrode 1 (side of the reference electrode 3) toward the upper side of the aperture electrode 1 (side of the control electrodes 4). Thus, the charged toner particles 22 attracted through the aperture electrode 1 are further attracted to the supporting member 10 by the back electrode 11 having positive electric potential (1 KV). The toner particles 22 are held on the supporting member 10 to form a toner dot.

On the other hand, when a picture element is determined as a non-image forming portion based on the image signal, a control electrode 4 corresponding to the picture element has the same potential applied to it as does the reference electrode 3, or the control electrode 4 is negatively charged. Then, since an electric field is not formed which favors the passage of charged particles through apertures 6, the back electrode 11 can not attract toner particles 22 toward the supporting member 10. If the control electrode 4 is negatively charged, the electric field which forms is directed from the upper side of aperture 6 toward lower side of the aperture 6, that is, electric lines of force flow from the side of the insulative layer 2 where the control electrodes 4 are formed toward the other side of the insulative layer 2 where the reference electrode 3 is formed. As a result, the toner particles 22 are controlled so as not to pass through the aperture 6.

The above-mentioned processing is repeated while the supporting member 10 is moved. Thus, an image made of the toner particles 22 is formed on the supporting member 10.

Figure 4:
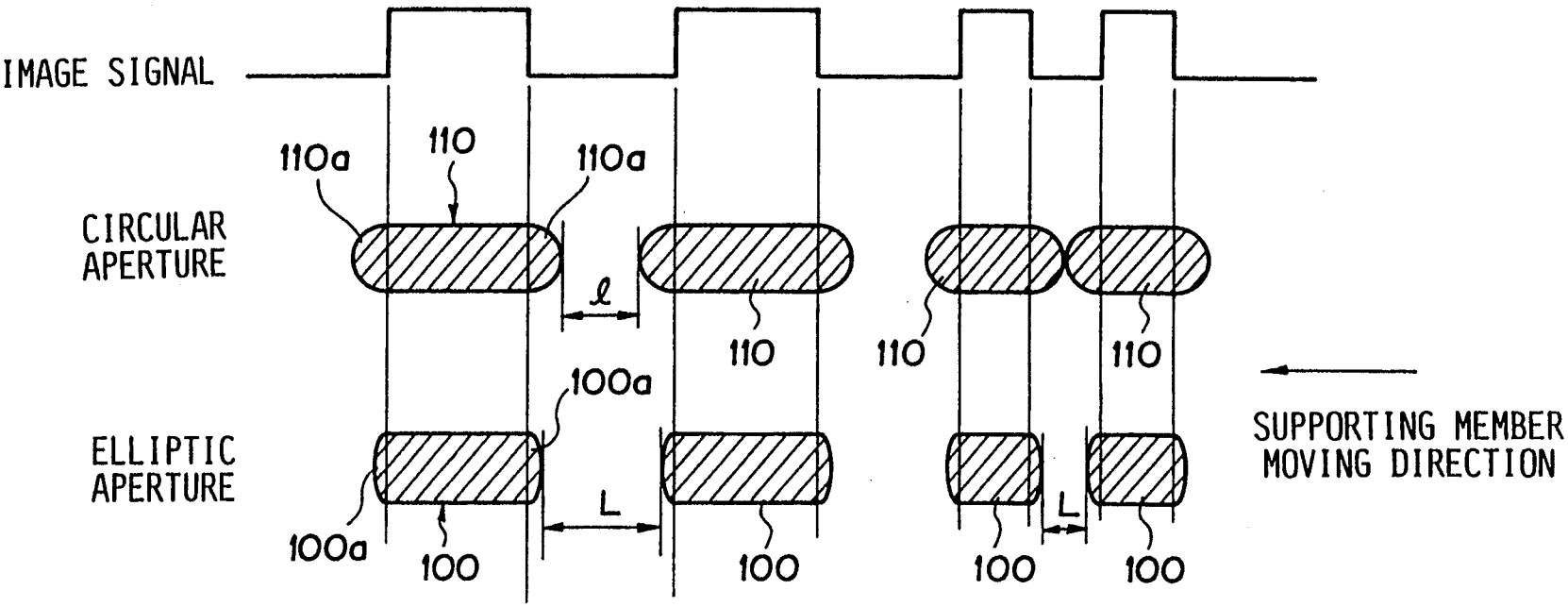
FIG. 4 is a view showing toner dots formed based on an image signal.

Toner dots for composing the toner dot image formed in accordance with the invention will be explained with reference to FIG. 4. FIG. 4 is a view showing some toner dots formed so as to correspond to the image signal. In FIG. 4, toner dots 100 formed by using elliptic apertures of the present invention are compared with toner dots 110 formed by using conventional circular apertures. Both ends 100*a* of the toner dot 100 formed by the image forming apparatus in the direction of movement of the supporting member 10 (in the direction shown by an arrow) are formed in the semi-ellipse shape corresponding to the aperture 6. That is, both ends 100*a* of the toner dot 100 are formed with the more gentle curved lines of the ellipse. On the other hand, both ends 110*a* of a toner dot 110 formed by using a circular aperture have the semicircle shape corresponding to the circular shape of the aperture. Therefore, when both ends 100*a* of the toner dot 100 formed by the image forming apparatus of the present invention are compared with both ends 110*a* of the toner dot 110 formed by using a circular aperture, the toner dot 100 of the present invention can correspond to rise and fall of the image signal more accurately. Therefore, an interval L between toner dots 100 adjacent to each other in the direction of movement of the supporting member 10 can be accurately formed based on a non-image forming part of the image signal. Even if the non-image forming part of the image signal is short (as shown in the right hand portion of FIG. 4), the interval L between toner dots 100 adjacent to each other is more accurately formed using the image forming apparatus of the present invention. However, if the non-image forming part of the image signal is short in the conventional image forming apparatus, there is the possibility that the interval 1 between toner dots 110 adjacent to each other is not formed. Therefore, when the image forming apparatus of the present invention is compared with the conventional image forming apparatus employing circular apertures, the image forming apparatus of the present invention has a high resolution.

In the above-mentioned embodiment, the apertures have elliptical shapes. However, this invention is not limited to the above-mentioned embodiment. The shape of the aperture may be an oval or other shapes wherein the dimension of the aperture extending in the direction of movement of the supporting member 10 is less than the dimension extending orthogonal to the direction of movement of the supporting member 10.

What is claimed is:

1. An image forming apparatus, comprising an aperture electrode having an insulative layer, a reference electrode formed on one side of the insulative layer, a plurality of control electrodes formed independently on another side of the insulative layer in a longitudinal direction of the insulative layer, and an elliptic aperture means having a major axis and a minor axis shorter than the major axis, formed in each of the control electrodes so as to penetrate the reference electrode, the insulative layer and the control electrodes, for forming a plurality of dots on a supporting member;

electric potential applying means for applying an electric potential between each of the control electrodes and the reference electrode, the dots formed by the elliptic aperture means on the supporting member closely conforming to the applied electric potential and improving image resolution;

charged toner particle supplying means for supplying charged toner particles to the aperture electrode; and moving means for effecting relative movement in a predetermined direction between the supporting member, to which the charged toner particles adhere after passing through the aperture electrode so as to form the plurality of dots, and the aperture electrode, the minor axis of the elliptic aperture means being parallel to the direction of relative movement between the supporting member and the aperture electrode.

2. An image forming apparatus as in claim 1, wherein the aperture electrode is fixed in position and the moving means moves the supporting member with respect to the aperture electrode.

3. An image forming apparatus as in claim 2, wherein the charged toner particle supplying means supplies the charged toner particles to a vicinity of the reference electrode and wherein the moving means moves the supporting member such that the supporting member passes adjacent to the aperture means of the control electrodes.

4. A toner particle modulator, comprising:

an elongate insulating layer having a longitudinal axis, a first side, and a second side opposite the first side;

a reference electrode formed on the first side;

a plurality of independent control electrodes on the second side and spaced from each other in the direction of said longitudinal axis; and an aperture formed in each control electrode, each aperture extending through one of the control electrodes, the insulative layer and the reference electrode, each aperture being of a shape defining a major axis and a minor axis, with the major axis having a greater length than the minor axis, the minor axis of each aperture extending transversely with respect to said longitudinal axis, wherein the ratio of the major axis to the minor axis is between about 1.5 to about 3.

5. The toner particle modulator of claim 4, wherein each aperture is elliptical.

6. The toner particle modulator of claim 4, wherein the minor axis of each aperture is orthogonal to said longitudinal axis.

7. An image forming apparatus, comprising:

an elongate insulating layer having a longitudinal axis, a first side, and a second side opposite the first side;

a reference electrode formed on the first side;

a plurality of independent control electrodes on the second side and spaced from each other in the direction of said longitudinal axis;

aperture means formed in each control electrode for forming a plurality of dots on a supporting member, each aperture means extending through one of the control electrodes, the insulative layer and the reference electrode, each aperture means being of a shape defining a major axis and a minor axis, with the major axis having a greater length than the minor axis, the minor axis of each aperture means extending transversely with respect to said longitudinal axis and parallel to a direction of movement between the supporting member and the elongate insulating layer;

electric potential applying means for applying an electric potential between the each of the control electrodes and the reference electrode, the dots formed by the aperture means on the supporting member closely conforming to the applied electric potential and improving image resolution;

charged toner particle supplying means for supplying charged toner particles to the vicinity of the reference electrode; and moving means for effecting relative movement between the supporting member, to which the charged toner particles adhere after passing through each aperture means so as to form the plurality of dots, and the control electrodes.

8. The image forming apparatus of claim 7, wherein each aperture means is elliptical.

9. The image forming apparatus of claim 8, wherein the ratio of the major axis to the minor axis from about 1.5 to about 3.

10. The image forming apparatus of claim 7, wherein the minor axis of each aperture means is orthogonal to said longitudinal axis.

11. The image forming apparatus of claim 10, wherein the ratio of the major axis to the minor axis is between about 1.5 to about 3.

12. The image forming apparatus of claim 11, wherein each aperture means is elliptical.

13. The image forming apparatus as in claim 7, wherein the insulating layer is fixed in position, the moving means moves the supporting member with respect to the control electrodes, and the minor axis of each aperture means is disposed parallel to the direction of movement of the supporting member.

14. The image forming apparatus as in claim 7, wherein the insulating layer is fixed in position, the moving means moves the supporting member with respect to the control electrodes, said longitudinal axis of the insulative layer is orthogonal to the direction of movement of supporting member and the minor axis of each aperture means is orthogonal to said longitudinal axis.

15. The image forming apparatus as in claim 14, wherein each aperture means is elliptical.

16. The image forming apparatus as in claim 15, further comprising:

a back electrode spaced from each control electrode so as to enable the supporting member to pass through between each control electrode and the back electrode; and a power supply connected to the back electrode so as to supply a predetermined level of electric potential to the back electrode, wherein the electric potential applying means applies a level of the electric potential between each of the control electrodes and the reference electrode lower than the predetermined level.

* * * * *